US006244988B1

(12) United States Patent
Delman

(10) Patent No.: US 6,244,988 B1
(45) Date of Patent: Jun. 12, 2001

(54) INTERACTIVE EXERCISE SYSTEM AND ATTACHMENT MODULE FOR SAME

(76) Inventor: David H. Delman, 71 Birchwood Park Dr., Jericho, New York, NY (US) 11753

( * ) Notice: Subject to any disclaimer, the term of this patent is extended or adjusted under 35 U.S.C. 154(b) by 0 days.

(21) Appl. No.: 09/340,363

(22) Filed: Jun. 28, 1999

(51) Int. Cl.[7] ..... A63B 71/00
(52) U.S. Cl. ..... 482/8; 482/9; 482/901
(58) Field of Search ..... 482/1–9, 51, 54, 482/57, 900–902

(56) References Cited

U.S. PATENT DOCUMENTS

| | | | | |
|---|---|---|---|---|
| 4,278,095 | | 7/1981 | Lapeyre . | |
| 4,298,893 | | 11/1981 | Holmes . | |
| 4,408,613 | | 10/1983 | Relyea . | |
| 4,512,567 | | 4/1985 | Phillips . | |
| 4,542,897 | | 9/1985 | Melton et al. . | |
| 4,556,216 | | 12/1985 | Pitkanen . | |
| 4,566,033 | | 1/1986 | Reidenouer . | |
| 4,637,605 | | 1/1987 | Ritchie . | |
| 4,842,266 | | 6/1989 | Sweeney, Sr. et al. . | |
| 4,976,435 | | 12/1990 | Shatford et al. . | |
| 5,001,632 | | 3/1991 | Hall-Tipping . | |
| 5,067,710 | | 11/1991 | Watterson et al. . | |
| 5,142,358 | | 8/1992 | Jason . | |
| 5,149,084 | | 9/1992 | Dalebout et al. . | |
| 5,213,555 | | 5/1993 | Hood et al. . | |
| 5,246,411 | | 9/1993 | Rackman et al. . | |
| 5,308,296 | | 5/1994 | Eckstein . | |
| 5,362,069 | | 11/1994 | Hall-Tipping . | |
| 5,456,648 | | 10/1995 | Edinburg et al. . | |
| 5,478,295 | | 12/1995 | Fracchia . | |
| 5,489,249 | | 2/1996 | Brewer et al. . | |
| 5,577,981 | | 11/1996 | Jarvik . | |
| 5,591,104 | | 1/1997 | Andrus et al. . | |
| 5,839,990 | * | 11/1998 | Virkkala | 482/8 |
| 5,888,172 | * | 3/1999 | Andrus et al. | 482/7 |
| 5,890,995 | * | 4/1999 | Bobick et al. | 482/4 |
| 5,896,164 | | 4/1999 | Orbach et al. . | |
| 6,004,243 | | 12/1999 | Ewert . | |

* cited by examiner

*Primary Examiner*—Glenn E. Richman
(74) *Attorney, Agent, or Firm*—Levisohn, Lerner, Berger & Langsam

(57) ABSTRACT

An improved interactive exercise system is disclosed. A simplified device for connecting fitness equipment such as an exercise bicycle to a computer is equipped with a game control device (e.g. industry standard computers equipped with a joystick or game port adapter). The invention also includes a self-contained exercise device. The act of exercising is converted into signals by a sensor which are then counted by the software and used to control an audio-visual display in such a way that pedaling speed can control the speed of what is been viewed. Hand operated switches allow the user to chose directions when the display indicates the user has come to a turning point. Various exercise parameters and progress towards goals are shown in a window on the display. Parameters and exercise data can be stored, reviewed, and used during other sessions. When used as an interactive exercise touring system, the user can literally pedal his way around the world, through the universe, or even through the human body, seeing the sights on the display screen and listening to a narrator describe what is being seen. By depressing the appropriate touch switches, the user can retrieve more information about a particular area and has the ability to pause the presentation at any time independent of the exercise activity. The device is linkable to other devices so that multiple users can tour a place together or compete against each other.

36 Claims, 4 Drawing Sheets

INTERACTIVE EXERCISE SYSTEM AND ATTACHMENT MODULE FOR SAME

BACKGROUND OF THE INVENTION

1. Field of the Invention

The present invention relates to exercise devices, specifically to such a device which can motivate and educate by allowing the user to interact mentally as well as physically with audiovisual information controlled by specific programs related to the device.

2. Description of Related Art

Exercise equipment of various types are well known in the art. In order for exercise to be effective it must be maintained for at least 15 minutes and must be performed regularly. One way to maintain motivation is to combine fitness equipment, such as an exercise bicycle, treadmill, or rowing equipment, with a video display thus making the exercising more interesting. Recently the use of computers in conjunction with exercise equipment has been explored. In spite of numerous earlier patents and applications, such products are still not available in sports, fitness, or computer shops. Neither are they being advertised in trade magazines. Past patents have not satisfied the requirements of the typical exerciser and indeed have misplaced emphasis on video games and thus have not met the needs of adults, the overwhelming number of users. Solutions of the following types have been presented in earlier patents.

Perhaps the simplest of these solutions is that of U.S. Pat. No. 4,298,893 to Holmes in which an exercise bicycle is used to generate electricity to power a television set. While it is simple it is not very interactive or interesting.

In U.S. Pat. No. 4,542,897 to Melton et al., a circuit allows the play of a video game if the user maintains a predetermined level of physical effort. This is a complex dedicated system that is not easily used in a home setting.

A computer can provide a number of functions in relation to the exercise equipment. In one system, U.S. Pat. No. 5,213,555 to Hood et al., a computer is used to gather data about multiple users of the equipment, and displays them on a screen in a competitive fashion. This complex system is suited only for use in a health club environment. Computers have been used to form a program of exercise and thus control the speed, effort required during exercise and other fitness related parameters as in U.S. Pat. No. 4,408,613 to Relyea. In U.S. Pat. No. 5,591,104 to Andrus et al., a physical exercise machine is connected to a video system through the use of a computer and the resultant effect is used to control the load resistance imposed in opposition to the movement of the pedals while optionally participating in a video game. These are all complex systems that are not easily configured for economical home use. They suffer from a lack of diversity in their interactivity and thus rapidly loose their motivating quality.

U.S. Pat. No. 5,149,084 to Dalebout et al. and U.S. Pat. No. 4,842,266 to Sweeney, Sr et al., use electronic icons which represent the user in a progress display and thus the user is supposed to be motivated to improve his performance by competing against a pacing icon or visualizing the progress around a track. These systems use icons to represent reality and are limited by their simplistic nature of their display.

A videotape cassette player displays a video of an outdoor exercise scene at a speed proportional to the users exercising speed in U.S. Pat. No. 4,278,095 to Lapeyre. This system lacks versatility and its interactivity is very limited.

A complex exercise apparatus suitable for muscle training is described in U.S. Pat. No. 4,556,216 to Pitkanen. This device is expensive, bulky, and unfit for other purposes. Its use is limited because it is dependant on a dedicated hardware system.

The system shown in U.S. Pat. No. 4,976,435 to Shatford et al., is a complex device which allows the user to play video games while exercising thus missing the most important target audience namely adults.

An interface to a game console using any kind of game software has been described. U.S. Pat. No. 4,512,567 to Phillips and U.S. Pat. No. 4,637,605 to Ritchie, describe equipment that allow playing a video game while using an the exercise bicycle as long as the bicycle is being pedaled fast enough. The utility of these systems is questionable since they require the use of a specially designed bicycle or mechanical add on and are designed around playing a video game which is not a very motivating activity for most adults.

A complex computerized exercise machine is described in U.S. Pat. No. 5.067,710 to Watterson et al., in which the resistance to exercise is controlled to maintain a target heart rate. This system while therapeutic does little to add to the motivation of the user.

Another very complex system has been used in a virtual reality setting, displaying the user superimposed over a computer generated image as in, U.S. Pat. No. 5,577,981 to Jarvik. The motivational aspects of this design are limited by its artificial virtual reality.

U.S. Pat. No. 5,001,632 to Hall-Tipping discloses a combination of a video game system and an exercise device whereby the play action is controlled by reference to the exerciser's heart rate and the output level of the exercise device. In U.S. Pat. No. 5,362,069 to Hall-Tipping the difficulty level of the exercise is controlled in an interactive fashion.

Apparatus for connecting an exercise bicycle to a computer U.S. Pat. No. 5,839,990 to Virkkala, describes an electronic circuit for connecting an exercise bicycle to a computer allowing the user to play computer games and control the speed of a character in the game. While this apparatus solves some of the deficiencies of the other systems noted, it still falls short of the goal to promote exercise through motivation in that it is suited mainly for a limited style of game playing. The population that most need exercise are adults and most adults are not motivated by playing video games.

An interactive video and exercise apparatus is described in U.S. Pat. No. 5,308,296 to Eckstein, in which the resistance to movement of an exercise device is varied in accordance to a scenario program being played on an interactive compact disc player. This involves a complex exercise system and while interactive, it's scenarios are limited to those specifically involving the person exercising thus they are monotonous, not educational, and lack the qualities that would keep a person exercising on a regular basis.

The video exercise control system, U.S. Pat. No. 5,489,249 to Brewer et al. is another complex and expensive system in which the user views scenes of various terrains and the exercise effort required is varied by a computer in synchronism with the terrain.

A system that interfaces a user-powered exercise machine, U.S. Pat. No. 5,478,295 to Fracchia is specifically dedicated to exercising towards a goal and progress towards this goal is the only motivating factor which detracts from its effectiveness and makes it monotonous and uninteresting.

Regardless of how well previous systems have performed in their respective intended environments, none of them is suitable if the user wishes to employ an exercise bicycle or other exercise equipment in an environment that is interactive, motivating and educational while running on an existing industry standard architecture computer. Most of these prior systems have been complicated, expensive, and not easily implemented, thus severely limiting the practicality of their use to exercise or research facilities that can afford the expense and are able to deal with their complexity. None of the past inventions focuses on the most likely users of such devices, namely adults. None of them is designed for educational uses as well. None of the aforementioned ideas is sufficiently simple and economically feasible such that they could be used on a wide scale basis or be simply adapted for use by non-technical persons on their home exercise equipment, while at the same time targeting the proper audience of users. None of the systems allows both the monitoring of exercise parameters as well as allowing the exerciser to control actual "live action" video scenes displayed on the video monitor. None of these systems allows for real time random access to the audio and or visual information.

SUMMARY OF THE INVENTION

It is therefore an object of this invention to provide a simple, inexpensive, and easily implemented interactive exercise system, which includes a method of interfacing an exercise machine to an industry standard computer and provides the user with a method of monitoring exercise and controlling the audio-video information on the display in synchronism to both the exercise and the users input.

It is another object of the invention to provide an apparatus and method of interfacing an exercise machine to a computer.

It is another object of the invention to provide an exercise system having a high degree of both mental and physical interactivity.

It is another object of the invention to provide an interactive exercise system that can present information in real time "live action" images and sounds.

It is another object of the invention to provide an interactive exercise system that is economical and easy to use.

It is another object of the invention to provide an interactive exercise system that is simple to manufacture and assemble.

It is another object of the invention to provide an interactive exercise system that can be used on industry standard personal computers and easily adapted for a wide variety of exercise equipment.

It is another object of the invention to provide an interactive exercise system that allows for a wide range of interesting and motivating subject matter to be utilized.

It is another object of the invention to provide an interactive exercise system that is not limited of being designed to be used solely as a game.

The above and other objects are fulfilled by the invention, which is an interactive exercise system, attachable to a piece of exercise equipment having at least one periodically moving part. The system includes a central processing unit (CPU) and a user sensory interface connected to the CPU that presents information from the CPU to the user. A sensor is attached to the periodically moving part of the equipment and is connected to the CPU. The sensor detects motion of the moving part and sends a first signal to the CPU. At least one touch switch is attachable to the exercise equipment and connected to the CPU. The touch switch selectively sends a second signal to the CPU. The CPU controls the information presented by the user sensory interface based on at least one of the first and second signals. Preferably, the sensor includes a speed sensor. The first signal indicates a first rate at which the user is exercising; the CPU refreshes the information presented to the user by the user sensory interface at a second rate proportional to the first rate at which the user is exercising.

The inventive exercise system preferably further includes a memory device connected to the CPU for storing the information to be presented on the user sensory interface. The CPU accesses the memory device to control the presentation of the information by the user sensory interface. The user sensory interface includes at least one of a visual display for showing visual information, an audio speaker for presenting aural information, and/or a tactile response unit such a Braille device for allowing the visually impaired to use the invention. The tactile response unit may also include some form of thermal or vibratory mechanism for providing other sensory information for reasons as will be explained below.

The touch switch, preferably a plurality of touch switches, sends out the second signal or signals to the CPU when depressed by the user. This second signal includes instructions to the CPU to enable the user to present selectable portions of the information on the user sensory interface. In the preferred embodiment, the second signal overrides the first signal in determining how the information is presented. These instructions include but are not limited to pausing the refreshment of the information, accessing more detailed aspects of the information, change the second rate independently of the first rate, and presenting secondary exercise information on the user sensory interface based on the first signal (the CPU calculates the secondary exercise information based on the first signal).

In addition to the inventive system mentioned above which can be attached to an existing piece of exercise equipment, the invention further includes a complete interactive exercise device. The device has at least one periodically moving part and a central processing unit (CPU) in communication with the moving part. A user sensory interface is connected to the CPU and presents information from the CPU to the user. A memory device is preferably connected to the CPU, and the information to be presented to the user is stored on the memory device. The CPU accesses the memory device to control the presentation of the information by the user sensory interface. A sensor is attached to the periodically moving part and is connected to the CPU. The sensor detects motion of the periodically moving part and sends a first signal to the CPU which indicates a first rate at which the user is exercising. At least one touch switch is attached to the equipment and connected to the CPU. The touch switch, when depressed by the user selectively sends a second signal to the CPU; the second signal includes instructions to the CPU to enable the user to present selectable portions of the information on the user sensory interface. The CPU controls the information presented by the user sensory interface based on at least one of the first and second signals, and the CPU refreshes the information presented by the user sensory interface at a second rate proportional to the first rate.

Further objects and advantages of my improved interactive exercise system will become apparent from a consideration of the drawings and ensuing description.

DETAILED DESCRIPTION OF THE PREFERRED EMBODIMENTS

Figure 1:
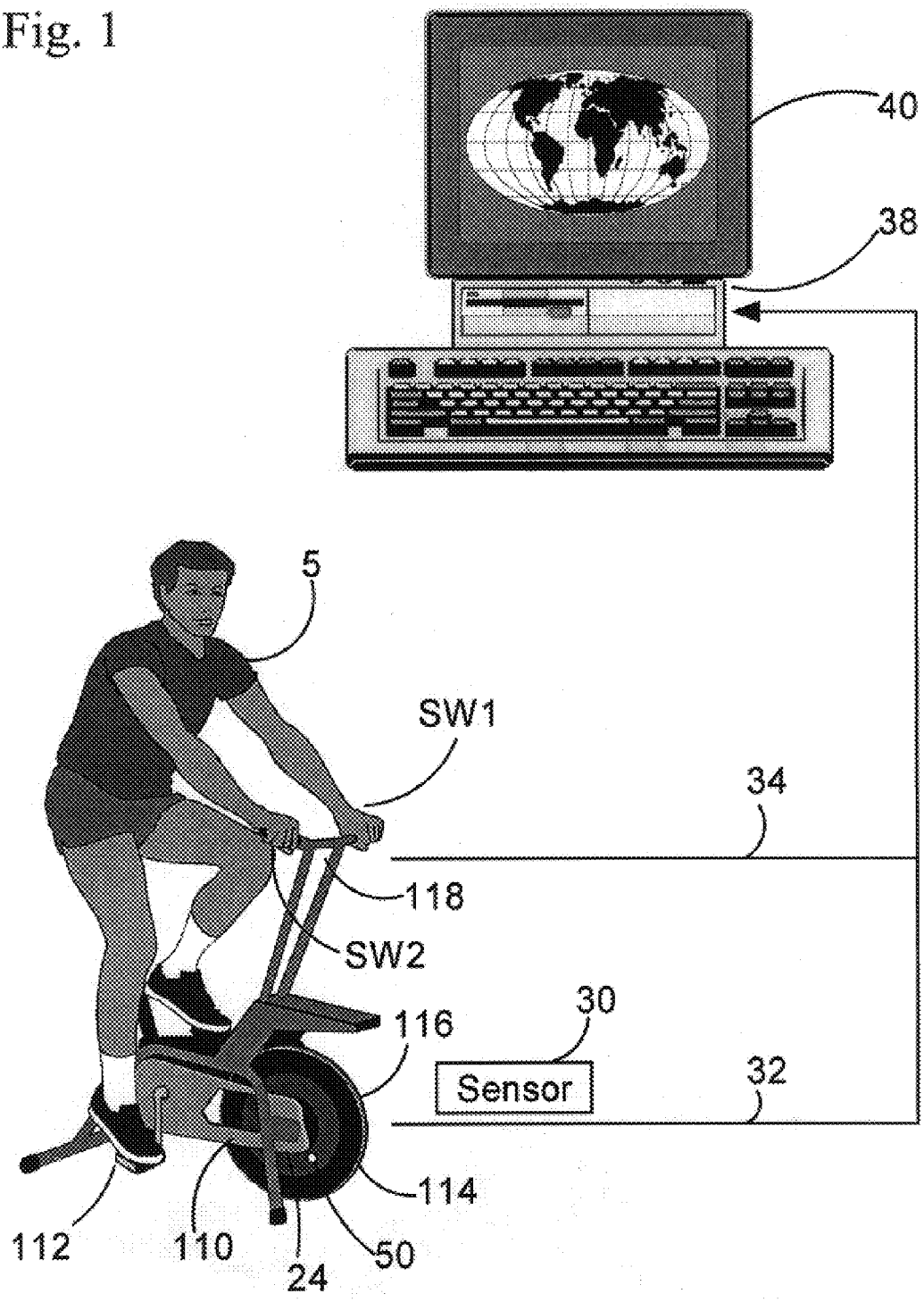
FIG. 1 is a perspective view showing one embodiment of the present invention in relation to a computer and an exercise bicycle.

Description of the invention will now be given with reference to FIGS. 1–4. The invention includes a system which is adapted to be connected to a conventional exercise cycle. The illustration in FIG. 1 shows how the system is connected to an exercise bicycle. The user 5 sits on a seat (not shown) placing his feet on pedals 112 of a standard stationary bicycle 110. Pedals 112 are mechanically linked to a flywheel 114 via a belt 116, or a chain, or other known conventional structure. The pedaling of the user causes flywheel 114 to rotate. The tension of flywheel 114, i.e., the difficulty one has pedaling owing to frictional resistance, is typically adjustable. Handlebars 118 are typically provided to simulate an actual bicycle more accurately. On certain computerized exercise cycles, handlebars 118 may be provided with controls for adjusting the tension on flywheel 114 and/or sensors for monitoring the user's heart rate.

In the instant invention, the simplified pulse or speed sensor 30 is mounted on or near the flywheel 114, pedals 112, the pedal crank (not shown), or any other similar periodically moving part of the exercycle. A pair of "steering" switches, SW1 and SW2 are mounted on the handlebars 118. The speed sensor 30 and switches SW1 and SW2 are designed so that they are directly connected to the joystick port of the computer 38 without the need for any active external circuitry; that is, sensor 30 is connected to computer 38 via line(s) 32, and handlebar switches SW1 and SW2 are connected to computer 38 via line(s) 34. Sensor 30 and switches SW1 and SW2 may be connected via any of a number of conventional means, such as by wires, by wireless radio transmitters and receivers, by photo-optical means, and the like. The joystick port of industry standard architecture computers consists of 2 input groups, in which each group consists of two continuously variable resistance inputs and two normally open switch inputs. For the purposes of this application the term joystick port is the same as the game port of the computer. A monitor 40 provides an audio-visual display for the user; handlebars 118 may be provided with a tactile response unit for providing information to the user in a Braille format, or for providing thermal or vibrational information.

Figure 2:
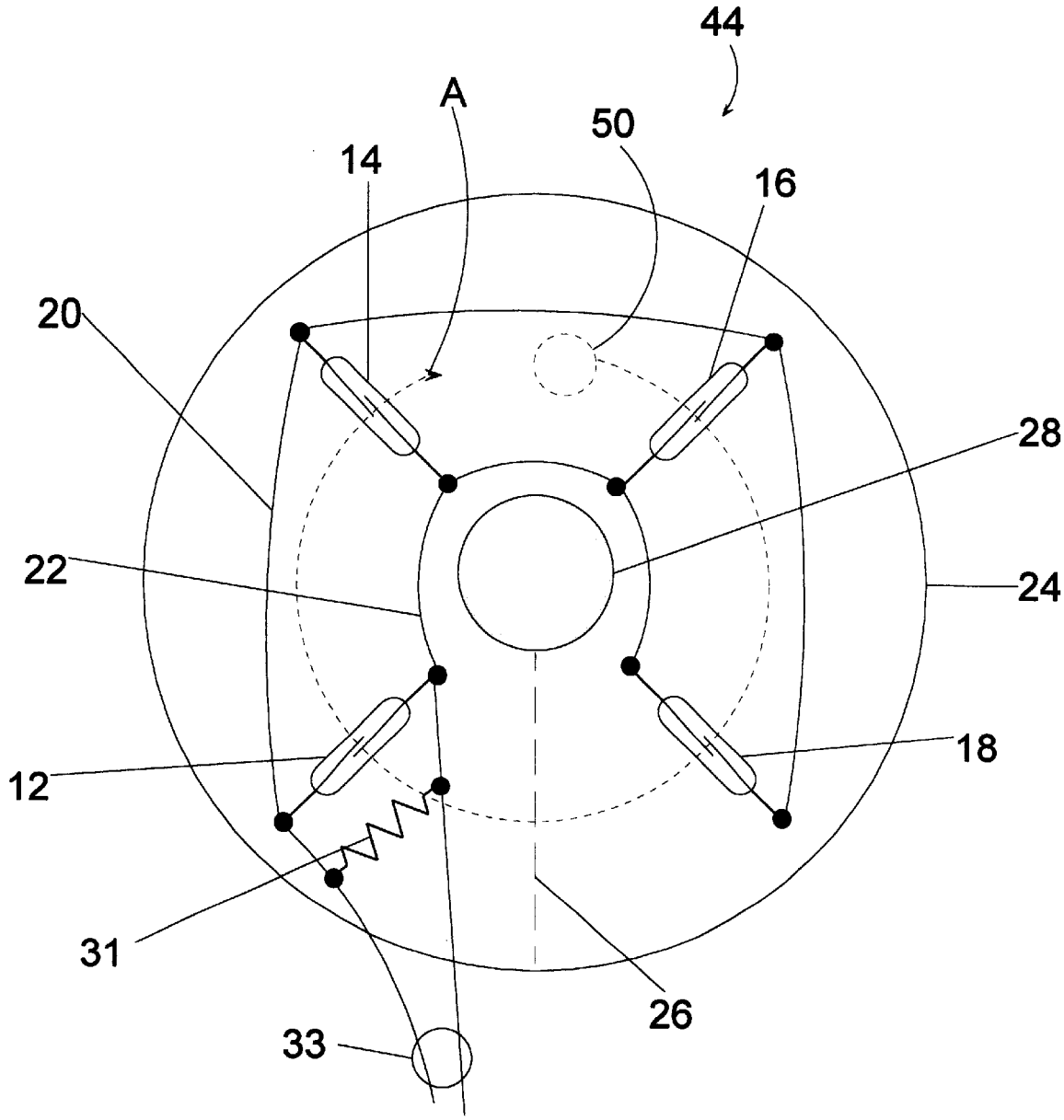
FIG. 2 is a front plan view of an exemplary embodiment of the simplified sensor.

FIG. 2 shows an embodiment of a simplified pulse or speed sensor assembly 44 which preferably includes four sensors 12, 14, 16, and 18. These are mounted in a radial fashion to a supporting element or mounting plate 24 made up of non-magnetic material. The individual sensors are connected in a parallel circuit, as shown by wires 20 and 22. The sensor assembly 24 preferably has a radial slit 26 cut into it and a hole 28 in the center to allow for easy application to the side of an exercise bicycle's chassis. Resistor 31, preferably a 100K ohm resistor, provides the proper loading for an industry standard joystick adapter. The senors are connected to the joystick port by means of the output wires 33. As shown in FIGS. 1 and 2, a magnet 50 is mounted directly to the flywheel 114 in proximity to or opposite mounting plate 24. Alternatively, the magnet 50 may be mounted to the fixed chassis of exercise cycle 110 and sensors 12–18 may be mounted on the rotating flywheel 114. In either case, this sensor unit interfaces the bicycle's flywheel motion to one of the four inputs available on an industry standard joystick port. Since the speed signal will be connected to the internal hardware which comprises an industry standard joystick port and is monitored by the system software, no other external hardware is required. The sensor is mounted or fastened to the exercise device in a conventional fashion, e.g., by glue, tape, self-sticking backing, screws, rivets, bolts, velcro, magnets, etc.

To simplify the sensor hardware, normally open magnetic reed switches are used as the sensors, 12, 14, 16, and 18, and they are connected directly to the resistance inputs of the joystick port. When a user exercises, flywheel 114 rotates, and magnet SO travels along arcuate A as shown in FIG. 2. Pulses corresponding to reed switch closure are formed by the passage of magnet 50 mounted on the flywheel or pedal crank in the close proximity of the reed switches. These pulses are counted by the software. The speed sensor is connected to the X or Y input of the joystick port and the software detects the change in resistance of the sensor and accordingly increases the value of the pulses counted. Thus parameters of speed, time, distance, and calories burned can be calculated by standard mathematical formulas once the distance traveled for one pedal rotation is measured. This simple calibration step can be accomplished by the person counting how many pedal revolutions, N are needed to travel one mile, thus the distance of one pedal revolution is 5,280/N as measured in feet. This factor is entered in the software computations of the parameters speed, distance, and calories burned.

In addition, the two "steering" switches in FIG. 1, SW1 and SW2 are mounted on the handlebars 118 and are likewise connected to two of the other inputs of a standard joystick port via lines 34. The software polls the condition of these switches and thus the user can interact directly with the program while exercising. This configuration leaves one of the four inputs available for other uses, when an industry standard four input joystick port is used. Also noted is that most industry standard joystick ports allow for the connection of two joysticks into the port thus allowing for a total of eight inputs.

Figure 3:
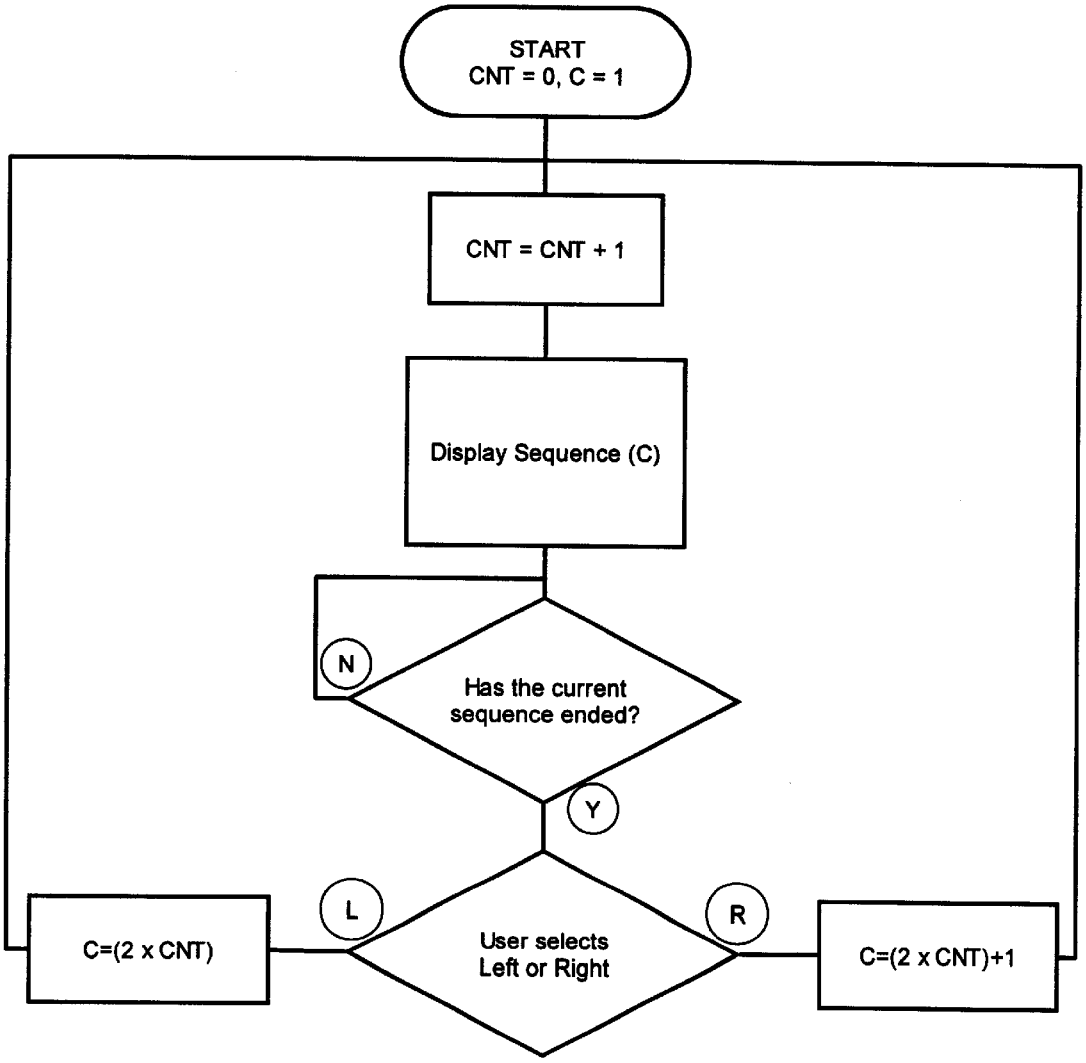
FIG. 3 is flow chart depicting one method of controlling the sequence of accessing interactive information.

FIG. 3 shows a flowchart representing a preferred method of controlling the sequence of accessing interactive information. The interactive information is stored as an array of audio-visual files, AV(1)–AV(n), where n represents the total number of audio-visual sequences. At the start of the program the count, CNT, and the display sequence subscript number, C, are initialized to 0 and 1 respectively. The count is incremented and an opening sequence, i.e., AV(1), is displayed, when C=1. At the end of the sequence the user is prompted to select left or right. When the user selects left the number of the next audio-visual sequence displayed is calculated by the formula, $C=(2\times CNT)$. When the user selects right the number the next sequence displayed is calculated by the formula, $C=(2\times CNT)+1$. It is by this method that the user can branch through a variety of display sequences.

In this preferred embodiment, the invention would be used as an interactive touring system in which the user could literally exercise his or her way around the world, through the universe, through the human body, or anywhere else that the audio-visual sequences has been made and stored in computer readable form. The information that makes up the tour can be stored in a local storage device, typically a CD-ROM or DVD disc. Unlike a video tape, this information can be accessed at "random" as opposed to the serial nature of a tape. Thus the user can rapidly branch to individual audio-visual segments. While touring various countries or sites, the audio-visual display would have a narrator describing what is being viewed. The speed of pedaling can also control the speed at which you "travel" by incorporating the calculated speed information from the speed sensor into the display command. That is, the rate that the information is updated to the user on the sensory interface by the CPU is generally proportional to the rate that the user is exercising. The actual speed at which the CPU communicates with the user sensory interface may not be affected, rather the perceived rate of information refreshment by the sensory interface is made generally proportional to the rate of exercise.

Additional means to control the speed at which the interactive information is presented to the user based on the information from the rate sensor can be implemented (via touch switches mounted on the handlebars 118, for example) as a command in Microsoft Visual Basic 5, MCIWnd1.Speed=S, where S is a number representing the speed of the displayed sequence and in this case is based on the fact that when S=1000, the speed is 100% of the normal speed. Thus, if a user is pedaling at the equivalent of 20 miles/hour, the audio-visual display need not be presented at an equivalent rate; rather, the user can slow down or speed up the proportional rate the information is refreshed. It is preferable that the information refreshment rate remain proportional to the speed at which the user is exercising. One could pause and take in the view by stopping pedaling, or one could pause the information via application of the appropriate touch switch(es) without ceasing to exercise. A means to control a pause in the audio-visual information can be implemented as a command in Microsoft Visual Basic 5, MCIWnd1.Command="Pause". At certain areas during the tour, there would be a cue to indicate that more detailed information about that particular area is available. A means to access more detailed information about a particular audio-visual segment can be achieved by prompting the user when an opportunity to get more information is available and then sensing if the user actuates one of the left or right switches SW1 or SW2 or other touch switches disposable on the handlebars 118. This would give the computer the command that can start a designated audiovisual segment. At the end of this more detailed segment, the user would be returned to the main audio-visual sequence. At turning points, e.g., when the audio-visual display would display an end to a road or an upcoming wall, for example, the switches SW1 and SW2 in FIG. 1 would represent turns to the right and left respectively. Thus, pushing a switch during the execution of the program would cause branching in the requested direction, giving the user the illusion of "turning" the stationary bicycle while touring abroad.

Alternatively, a second sensor can be mounted on the handlebars 118 to detect rotation of the handlebars. That is, for exercise cycles on which the handlebars can be turned in simulation of the turning of handlebars on a real bicycle, a motion or position sensor can be mounted on the handlebars and the chassis to determine if and by how much the handlebars have been rotated from a "dead ahead" position. The rotation of the handlebars would be detected by the sensor, which would send a signal to computer 38, which would, in turn, alter the view displayed on monitor 40 in accordance with the "turn" instructions of the handlebar sensor.

Figure 4:
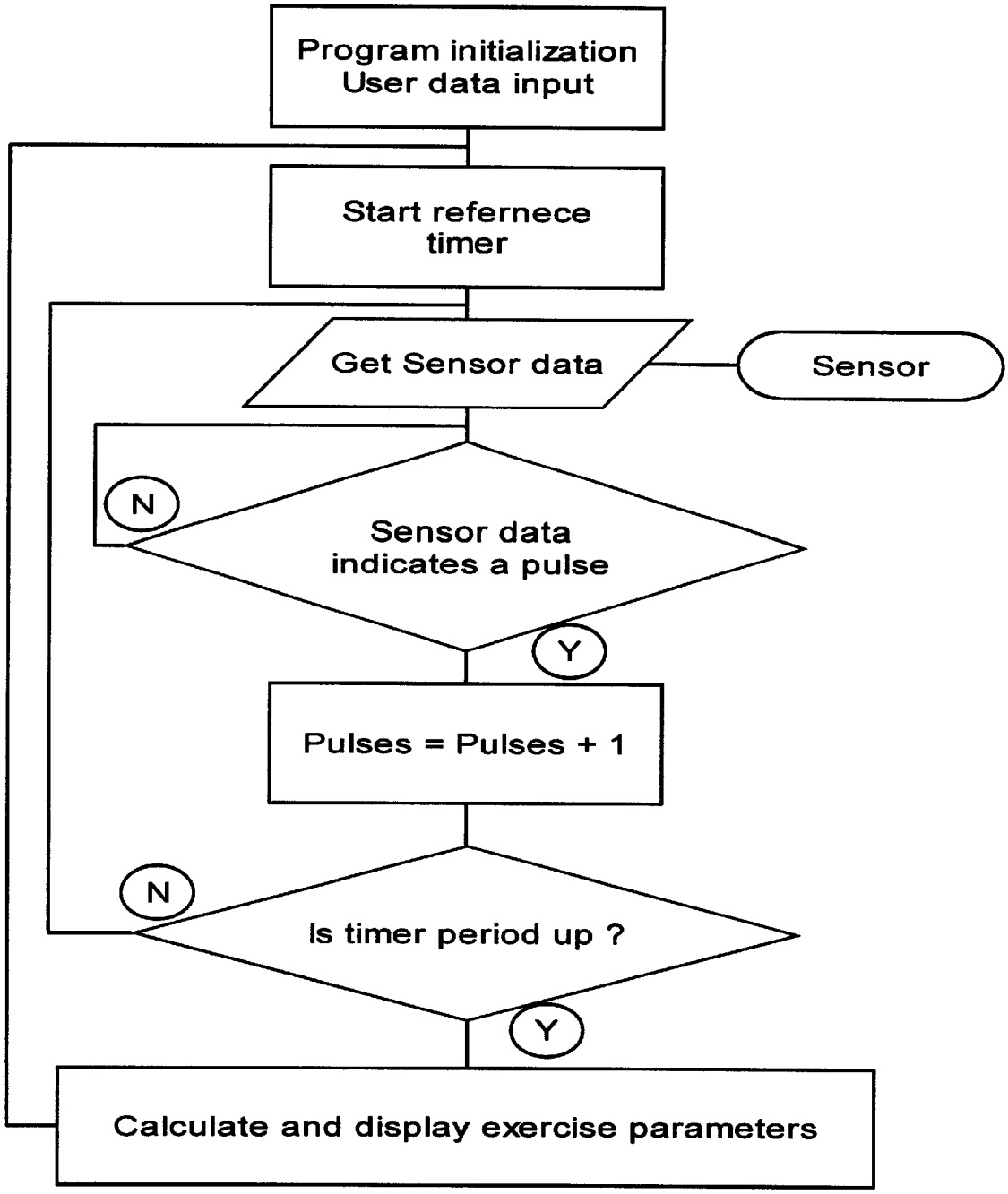
FIG. 4 is a flow chart depicting one method of computing and displaying exercise information obtained from the rate sensor.

FIG. 4 shows a flowchart representing a program for counting the pulses produced by the sensor and thus provides a means to compute and display exercise information obtained from the data. The software can calculate exercise parameters such as duration of exercise, average, and instantaneous speed, distance traveled, and calories burned, using standard mathematical formulas. These parameters can also be shown in a window within the display screen along with the audio-visual segment. These parameters can be displayed in a standard numerical format or can be displayed in a graphical fashion such as speedometer, bar graph, or pie chart. A database of information stored in the computer will allow users to review past exercise sessions and view cumulative data about multiple sessions. The system is designed for use by multiple individuals who's data is retrievable separately. Individual users can enter exercise goals and the progress towards these goals will be displayed in numerical and or graphical form.

The invention is not limited to the above description. Other configurations of the same type of sensor could be configured to be used with other types of exercise equipment such as bicycles, treadmills, rowing machines, stair climbers, skiing machines, elliptical machines, stepper machines, resistance training machines, and weight lifting machines. Further, although the above description and drawings describe a magnetic sensor, other types of sensors are equally applicable. For example, the sensor may include a light source and one or more photodetectors instead of a magnet and one or more magnetic reed switches. When the light source comes into proximity with the photodetector, the light source causes the photodetector to send a pulse to the computer in a fashion similar to that described above. The sensor may also or alternatively include optical, motion, sound, vibration, heat, chemical, nuclear, mechanical, or other magnetic elements such as Hall effect sensors and the like. Further, the sensor may be connected to the computer via a joystick port, game port, parallel port, serial port, and universal serial bus. The preferred sensor assembly is shown having four sensors radially mounted. However, the invention only requires one sensor and may employ any number of sensors as is convenient and/or necessary for a given application. Similarly, it need not be limited to one magnet, light source, or the like, but may incorporate multiple of same. Also, the sensors need not be radially mounted; rather, any geometry that can enable determination of the speed of an exercise device's periodic motion is within the scope of the invention.

Additional parameters of exercise may be monitored and/or displayed such as exercise rate, heart rate, oxygen consumption, respiratory rate, carbon dioxide production, electrocardiographic information, electroencephalograhic parameters, and electroretinographic data. These parameters can be input from sensors through the spare inputs of the industry standard joystick port.

The computer can be connected to a network or Internet connection to provide additional information storage and retrieval capabilities. Multiple units can be networked together such that competitions can be formed either locally or via the Internet. In this way, exercise classes may be held (whether all of the participants are in the same location or not) that simulate a tour of a given locale. Individual machines may all be set up to follow the class leader, e.g., by providing a single computer for the whole class or by disabling the handlebar switches, or each individual user may be allowed to "wander off the tour" by activating his/her controls.

Similarly, the memory or storage media for storing the interactive information, may include magnetic disc, compact disc, video disk, DVD, CD-ROM, RAM, ROM, PROM, EPROM, EEPROM, network storage, and Internet storage.

All forms of information storage are contemplated as being within the scope of the invention.

Also, additional user parameters may be monitored. The parameters of the user's participation may include the user's answers to test questions, reaction time, visual acuity, auditory acuity, muscle strength, motor coordination, skin sensation, galvanic skin response and the like.

The invention may also include an additional memory upon which a user's exercise and other parameters may be stored and later retrieved. A database of information is storable in this memory to allow users to review past sessions, view cumulative data about multiple sessions, and incorporate data from past sessions into a cumulative database. Preferably, the system is designed for use by multiple individuals whose data is retrievable separately. Users may preferably be able to enter goals, and the progress towards these goals will be displayed.

As mentioned above, the user sensory interface may include a video monitor, an audio speaker, and a tactile response unit capable of providing touch sensory information. Aside from providing information in a Braille format for the visually impaired, a tactile response unit can be adapted to provide thermal and vibrational information. For example, if the interactive information includes a bike tour, the thermal information could be used to represent or simulate changes in climate. Similarly, the vibrational information could be used to represent or simulate changes in road conditions. Other sensory devices are deemed to be included within the scope of the invention; the invention should not be limited to the examples discussed herein.

The inventive interactive exercise system provides numerous advantages over prior art. First, it is compatible with existing computers. Using an industry standard computer can be transformed from a sedentary activity to a physically active one, and thus help prevent the problems associated with the epidemic lack of physical fitness that is emerging as our society becomes more and more technically advanced. Moreover, the invention can be manufactured as a modification or retrofit kit that can be easily installed by the user. Because of its simplified interface, it is inherently less expensive and more reliable. The invention also maintains motivation for the user by providing real-time "live" interaction with the audio-visual display while at the same time displaying parameters of exercise and progress towards a goal. The invention is flexible in that it can be used as a device more suited to motivate adults, the population who could benefit most from exercise.

While the above description contains many features, these should not be construed as limitations on the scope of the invention, but rather as an exemplification of the preferred embodiments thereof. Many other variations are possible. For example the system could be used as an educational device and be programmed to present self-study material which could be learned while doing exercise. Additional programming could be added such that the user would have to answer questions by activating the switches SW1 and SW2. The program could evaluate the answers and be able to score the users answers. The reaction time of the user could be tested by timing how long it took to press a certain switch after an audio or visual signal was given. The visual and auditory acuity of the user could be incorporated in or be tested by the system by displaying objects of varying size for specific time period or delivering various sound frequencies for specific time periods.

Numerous variations of the above described system can occur to those skilled in the art. The invention is not to be limited to that described; rather, the scope of the invention should be determined not by the embodiments discussed, but by the appended claims and their legal equivalents.

I claim:

1. An interactive exercise system, attachable to an existing piece of conventional exercise equipment having at least one periodically moving part, comprising:

a central processing unit (CPU);

a memory device connected to said CPU, with information being stored on said memory device in discrete packets of information;

a user sensory interface, connected to said CPU, presenting said information from said memory device to the user in discrete packets of information, said CPU accessing said memory device to control the presentation of said information by said user sensory interface;

a sensor attached to the periodically moving part of the equipment and connected to said CPU, said sensor detecting motion of the moving part and sending a first signal to said CPU; and at least one touch switch attachable to the equipment and connected to said CPU, said touch switch selectively sending a second signal to said CPU, wherein said CPU controls said information presented by said user sensory interface based on at least one of said first and second signals.

2. An interactive exercise system according to claim 1, said sensor comprising a speed sensor, wherein said first signal indicates a first rate at which the user is exercising and wherein said CPU refreshes said information presented by said user sensory interface at a second rate proportional to said first rate.

3. An interactive exercise system according to claim 2, wherein said second signal comprises instructions to said CPU to enable the user to present selectable portions of said information on said user sensory interface.

4. An interactive exercise system according to claim 3, wherein said second signal overrides said first signal in determining how said information is presented.

5. An interactive exercise system according to claim 3, said instructions comprising at least one of the following instructions:

pause the refreshment of said information;

access more detailed aspects of said information;

change said second rate independently of said first rate; and present secondary exercise information on said user sensory interface based on said first signal, wherein said CPU calculates said secondary exercise information based on said first signal.

6. An interactive exercise system according to claim 5, further comprising memory, connected to said CPU, upon which said secondary exercise information is storable and retrievable.

7. An interactive exercise system according to claim 3, said CPU being directly connected to the periodically moving part and controlling a degree of difficulty the user has in moving the periodically moving part, wherein said second signal further instructs said CPU to alter the degree of difficulty in response to the user activating said touch switch.

8. An interactive exercise system according to claim 1, further comprising a memory device connected to said CPU, said information being stored on said memory device, said CPU accessing said memory device to control the presentation of said information by said user sensory interface.

9. An interactive exercise system according to claim 8, wherein said CPU is connectable to at least one other CPU of at least one other interactive exercise system thereby enabling a plurality of users to selectively access said information from said memory device simultaneously.

10. An interactive exercise system according to claim 8, wherein said CPU is connectable to at least one other CPU of at least one other interactive exercise system via the Internet thereby enabling a plurality of users to selectively access said information from said memory device simultaneously.

11. An interactive exercise system according to claim 1, wherein said user sensory interface comprises at least one of a visual display, an audio speaker, and a tactile response unit.

12. An interactive exercise system according to claim 1, said sensor comprising:

a first element attached to the moving part of the equipment;

a second element attached to a fixed part of the equipment and adapted to detect motion of said first element, wherein when said second element detects motion of said first element, said sensor sends said first signal to said CPU.

13. An interactive exercise system according to claim 12, said first element comprising one of at least one magnet and at least one magnetic reed switch, and said second element comprising the other of at least one magnet and at least one magnetic reed switch, wherein when said magnet comes into proximity with said magnetic reed switch, said magnet causes said reed switch to close and send a pulse to said CPU, a plurality of said pulses creating said first signal.

14. An interactive exercise system according to claim 12, said first element comprising one of at least one light source and at least one photodetector, and said second element comprising the other of at least one light source and at least one photodetector, wherein when said light source comes into proximity with said photodetector, said light source causes said photodetector to send a pulse to said CPU, a plurality of said pulses creating said first signal.

15. An interactive exercise system according to claim 1, further comprising a second sensor attached to a movable part of the equipment, said second sensor detecting movement of the movable part and sending a third signal to said CPU, wherein said CPU controls said information presented by said user sensory interface based on at least one of said first, second, and third signals.

16. An interactive exercise system according to claim 15, said second sensor being attached to handlebars of the equipment, wherein movement of the handlebars by the user causes said second sensor to send said third signals to said CPU to control presentation of said information.

17. An interactive exercise system according to claim 1, wherein the piece of exercise equipment comprises one of a bicycle, a treadmill, a rowing machine, a stair climber, a skiing machine, an elliptical machine, a stepper machine, a resistance training machine, and a weight lifting machine.

18. An interactive exercise system, comprising:

a piece of conventional exercise equipment having at least one periodically moving part;

a central processing unit (CPU) in communication with said equipment;

a user sensory interface, connected to said CPU, presenting information from said CPU to the user in discrete packets of information;

a memory device connected to said CPU, said information being stored on said memory device in discrete packets of information, said CPU accessing said memory device to control the presentation of said information by said user sensory interface;

a sensor attached to said periodically moving part and connected to said CPU, said sensor detecting motion of said periodically moving part and sending a first signal to said CPU, said first signal indicates a first rate at which the user is exercising; and at least one touch switch attachable to said equipment and connected to said CPU, said touch switch selectively sending a second signal to said CPU, said second signal including instructions to said CPU to enable the user to present selectable portions of said information on said user sensory interface, wherein said CPU controls said information presented by said user sensory interface based on at least one of said first and second signals, and wherein said CPU refreshes said information presented by said user sensory interface at a second rate proportional to said first rate.

19. An interactive exercise system according to claim 18, wherein said second signal overrides said first signal in determining how said information is presented.

20. An interactive exercise system according to claim 18, said instructions comprising at least one of the following instructions:

pause the refreshment of said information;

access more detailed aspects of said information;

change said second rate independently of said first rate; and present secondary exercise information on said user sensory interface based on said first signal, wherein said CPU calculates said secondary exercise information based on said first signal.

21. An interactive exercise system according to claim 20, further comprising memory, connected to said CPU, upon which said secondary exercise information is storable and retrievable.

22. An interactive exercise system according to claim 18, wherein said user sensory interface comprises at least one of a visual display, an audio speaker, and a tactile response unit.

23. An interactive exercise system according to claim 18, said sensor comprising:

a first element attached to the moving part of said equipment;

a second element attached to a fixed part of said equipment and adapted to detect motion of said first element, wherein when said second element detects motion of said first element, said sensor sends said first signal to said CPU.

24. An interactive exercise system according to claim 23, said first element comprising one of at least one magnet and at least one magnetic reed switch, and said second element comprising the other of at least one magnet and at least one magnetic reed switch, wherein when said magnet comes into proximity with said magnetic reed switch, said magnet causes said reed switch to close and send a pulse to said CPU, a plurality of said pulses creating said first signal.

25. An interactive exercise system according to claim 23, said first element comprising one of at least one light source and at least one photodetector, and said second element comprising the other of at least one light source and at least one photodetector, wherein when said light source comes into proximity with said photodetector, said light source causes said photodetector to send a pulse to said CPU, a plurality of said pulses creating said first signal.

26. An interactive exercise system according to claim 18, wherein said CPU is connectable to at least one other CPU of at least one other interactive exercise system thereby enabling a plurality of users to selectively access said information from said memory device simultaneously.

27. An interactive exercise system according to claim 18, further comprising a second sensor attached to a movable part of said equipment, said second sensor detecting movement of said movable part and sending a third signal to said CPU, wherein said CPU controls said information presented by said user sensory interface based on at least one of said first, second, and third signals.

28. An interactive exercise system according to claim 27, said equipment comprising handlebars, said second sensor being attached to said handlebars, wherein movement of said handlebars by the user causes said second sensor to send said third signals to said CPU to control presentation of said information.

29. An interactive exercise system according to claim 18, wherein said piece of exercise equipment comprises one of a bicycle, a treadmill, a rowing machine, a stair climber, a skiing machine, an elliptical machine, a stepper machine, a resistance training machine, and a weight lifting machine.

30. An interactive exercise system according to claim 18, said CPU being directly connected to the periodically moving part and controlling a degree of difficulty the user has in moving the periodically moving part, wherein said second signal further instructs said CPU to alter the degree of difficulty in response to the user activating said touch switch.

31. An interactive exercise system, comprising:

a conventional stationary exercise bicycle, having a frame, movable pedals mounted on said frame, a rotatable element mounted on said frame connected to said pedals, said rotatable element moving in response to user force being applied to said pedals;

a central processing unit (CPU) in communication with said rotatable element;

a user sensory interface, connected to said CPU including at least one of a visual display, an audio speaker, and a tactile response unit, said interface presenting information from said CPU to the user in discrete packets of information;

a memory device connected to said CPU, said information being stored on said memory device in discrete packets of information, said CPU accessing said memory device to control the presentation of said information by said user sensory interface;

a sensor attached to said rotatable element and connected to said CPU, said sensor detecting rotation of said rotatable element and sending a first signal to said CPU, said first signal indicates a first rate at which the user is exercising; and at least one touch switch attachable to said frame and connected to said CPU, said touch switch selectively sending a second signal to said CPU, said second signal including instructions to said CPU to enable the user to present selectable portions of said information on said user sensory interface, wherein said CPU controls said information presented by said user sensory interface based on at least one of said first and second signals, and wherein said CPU refreshes said information presented by said user sensory interface at a second rate proportional to said first rate.

32. A kit for retrofitting an existing piece of conventional exercise equipment having at least one periodically moving part into an interactive exercise device, comprising:

a central processing unit (CPU);

a memory device connected to said CPU, with information being stored on said memory device in discrete packets of information;

a user sensory interface, connected to said CPU, presenting said information from said memory device to the user in discrete packets of information, said CPU accessing said memory device to control the presentation of said information by said user sensory interface;

a sensor attached to the periodically moving part of the equipment and connected to said CPU, said sensor detecting motion of the moving part and sending a first signal to said CPU; and at least one touch switch attachable to the equipment and connected to said CPU, said touch switch selectively sending a second signal to said CPU, wherein said CPU controls said information presented by said user sensory interface based on at least one of said first and second signals.

33. A kit for retrofitting an existing piece of conventional exercise equipment according to claim 32, wherein said first signal is indicative of a first rate at which the user is moving the periodic part of the exercise equipment and said CPU changes a second rate at which information is updated on said user sensory interface based on said first rate, and wherein said second signal is a user-generated selection signal which overrides said first signal.

34. A kit for retrofitting an existing piece of conventional exercise equipment having at least one periodically moving part into an interactive exercise device, comprising:

a sensor attached to the periodically moving part of the equipment and connectable to a computer, the computer having a central processing unit (CPU) and a memory device, said sensor detecting motion of the moving part and sending a first signal to said CPU;

at least one touch switch attachable to the equipment and connected to the CPU of the computer, said touch switch selectively sending a second signal to the CPU; and a memory medium readable by the memory device of the computer, said memory medium having discrete packets of information stored thereon, said information being compatible with a user sensory interface, wherein the computer controls the information transmitted to the user sensory interface based on at least one of said first and second signals.

35. A kit for retrofitting an existing piece of conventional exercise equipment according to claim 34, wherein said first signal is indicative of a first rate at which the user is moving the periodic part of the exercise equipment and the computer changes a second rate at which information is updated on said user sensory interface based on said first rate, and wherein said second signal is a user-generated selection signal which overrides said first signal.

36. An interactive exercise system, comprising:

a piece of exercise equipment having at least one periodically moving part;

a sensor attached to the periodically moving part of the equipment and connectable to a computer, the computer having a central processing unit (CPU) and a memory device, said sensor detecting motion of the moving part and sending a first signal to said CPU;

at least one touch switch attachable to the equipment and connected to the CPU of the computer, said touch switch selectively sending a second signal to the CPU; and a memory medium readable by the memory device of the computer, said memory medium having discrete packets of information stored thereon, said information being compatible with a user sensory interface, wherein the computer controls the information transmitted to the user sensory interface based on at least one of said first and second signals.

* * * * *